US006685497B1

(12) United States Patent
Urban et al.

(10) Patent No.: US 6,685,497 B1
(45) Date of Patent: Feb. 3, 2004

(54) APPARATUS FOR CONNECTING CONDUCTORS

(75) Inventors: Blake R. Urban, Lenior, NC (US); Isaac D. M. White, Orlando, FL (US); James E. Dickens, Ocoee, FL (US); Kevin Forsberg, Orlando, FL (US); Charles Sawyer, Orlando, FL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/330,454

(22) Filed: Dec. 28, 2002

(51) Int. Cl.[7] ..... H01R 4/24
(52) U.S. Cl. ..... 439/417; 439/519; 439/402
(58) Field of Search ..... 439/417, 499, 439/495, 470, 402, 76, 395, 405, 404, 403, 418, 409, 98, 163, 910, 912, 426, 482, 425, 519–521

(56) References Cited

U.S. PATENT DOCUMENTS 4,435,034 A 3/1984 Aujla et al.
4,533,201 A * 8/1985 Wasserlein, Jr. ..... 439/404
5,746,610 A * 5/1998 Shiu ..... 439/98
5,820,404 A * 10/1998 Chishima et al. ..... 439/417
6,080,006 A * 6/2000 Broder ..... 439/409
6,111,201 A * 8/2000 Drane et al. ..... 174/92
6,361,353 B1 * 3/2002 Saka et al. ..... 439/405

* cited by examiner

*Primary Examiner*—P. Austin Bradley
*Assistant Examiner*—Phuongchi Nguyen
(74) *Attorney, Agent, or Firm*—Walters & Zimmerman; Geoff Sutcliffe; Todd Mitchem

(57) ABSTRACT

An apparatus is disclosed for connecting at least two conductors. One embodiment has a body and a cap engaging the body. The body has an open top to an interior region. The body has at lest two apertures extending through a body side wall and into an interior region of the body. The cap has a cavity downwardly extending from a top surface of the cap toward a bottom surface of the cap. The cavity terminates at a floor between the top surface and the bottom surface of the cap, and the floor has a puncturable thickness to provide access to the interior region of the body.

14 Claims, 5 Drawing Sheets

APPARATUS FOR CONNECTING CONDUCTORS

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but the copyright owner otherwise reserves all copyrights whatsoever.

BACKGROUND OF THE INVENTION

1. Field of the Invention

This invention generally relates to electrical conductors and, more particularly, to connectors for electrical conductors.

2. Description of the Related Art

Connectors are used throughout the telecommunications industry, and the electronics industry in general, to connect wires. These connectors allow one wire, or "conductor," to be spliced or electrically connected to another wire. Although these connectors are used throughout the electronics industry, these connectors are particularly suited for connection of the Ring and Tip conductors of telephone systems. The wires to be connected are typically inserted into the connector, and the connector is crimped or clamped to electrically connect the wires.

Although there are many existing connectors, of varying designs, these prior art connectors have disadvantages. Some prior art connectors, for example, have no means of testing the connected wires. Once these connectors are crimped, there is no access hole or passage that permits insertion of a test probe. If a craftsperson must test the connection, the craftsperson must first cut the connector from the wires. The wires are then stripped of their outer insulation, and the craftsperson takes current and voltage measurements. If no problem is found, the connector was needlessly, and wastefully, removed. The craftsperson must install a new connector and then choose another connector to test. The lack of a test access hole makes troubleshooting a slow task, and many good, functioning connectors are wasted during this troubleshooting process.

Some prior art connectors, however, do have access holes. After the wires are crimped in the connector, the test access hole allows insertion of a test probe. While this test access hole allows the craftsperson to test the connection without discarding the connector, this test access hole promotes corrosion of the connection. Because these prior art connectors are designed with a pre-existing access hole, the connection between the wires is immediately susceptible to environmental degradation. As soon as the connector is crimped in the field, moisture enters through the test access hole and begins to corrode the terminal connecting the wires. Even if the connector is injected with a moisture-resistant gel, often times the gel does not penetrate the test access hole and completely seal the connector. Moisture still enters the connector and attacks the terminal. There is, accordingly, a need in the art for a connector that permits testing the electrical connection, yet a connector that is less susceptible to moisture entry and eventual corrosion.

BRIEF SUMMARY OF THE INVENTION

This invention is an apparatus for connecting conductors. This apparatus allows a telecommunications technician, or other craftsperson, to quickly make an electrical connection between at least two conductors. The term "conductors" describes the wires, cables, and other mediums that carry, or "conduct," electrons from one location to another location. Once the conductors are electrically connected, the apparatus of this invention has a puncturable cavity that allows test access to the conductors. The apparatus has an open-top body and a cap that fits into, or over, the body. The craftsperson inserts the ends of the conductors into the body, and the craftsperson then assembles the cap to the body. As the cap pushes onto the body, the conductors are crimped to a terminal inside the apparatus. If the craftsperson must test the electrical connection, the craftsperson can puncture the cavity and insert a test probe. The craftsperson may then test voltages and currents at the terminal.

This puncturable cavity provides a more reliable connector. The connector of this invention is moisture-resistant until the cavity is punctured. Whereas the prior art connectors are assembled with an existing test access hole, the connector of this invention is not exposed to moisture until the cavity is punctured. When the connection must be tested, the cavity is then punctured. Because months or even years may pass before the connection need be tested, the connector of this invention has a longer, moisture-resistant life. Any onset of corrosion is delayed until the cavity is punctured.

One embodiment of this invention describes an apparatus for connecting at least two conductors. This apparatus comprises a box-like body and a cap engaging the body. The body comprises a bottom, an open top, at least one body side wall, and at least two apertures. The at least one side wall extends up from the bottom of the body. Each of the at least two apertures extend through the body side wall and into an interior region of the body. The top is open to the interior region of the body. The cap has a top surface, a bottom surface, at least one cap side wall, and a cavity. The at least one cap side wall extends down from the bottom surface of the cap. The cavity downwardly extends from the top surface of the cap toward the bottom surface of the cap, and the cavity terminates at a floor. The floor lies between the top surface of the cap and the bottom surface of the cap, and the floor has a puncturable thickness to provide access to the interior region of the body. The at least two conductors are positioned in the apertures, and when the cap and the body engage, the at least two conductors are crimped in electrical connection with a terminal in the interior region of the body, and the floor in the cavity may be punctured to provide access to the terminal.

Another embodiment also describes an apparatus for connecting at least two conductors. This apparatus comprises a box-like body and a cap engaging the body. The body comprises a bottom, an open top, at least one body side wall, at least two apertures, and a cavity. The at least one side wall extends up from the bottom of the body. Each of the at least two apertures extend through the body side wall and into an interior region of the body. The top is open to the interior region of the body. The cavity extends from an outer surface of the body toward an inner surface of the body, and the cavity terminates at an cavity end wall having a puncturable thickness to provide access to the interior region of the body. Wherein the at least two conductors are positioned in the apertures, and when the cap and the body engage, the at least two conductors are crimped in electrical connection with a terminal in the interior region of the body, and the floor in the cavity end wall may be punctured to provide access to the terminal.

BRIEF DESCRIPTION OF THE SEVERAL VIEWS OF THE DRAWINGS

These and other features, aspects, and advantages of this invention are better understood when the following Detailed Description of the Invention is read with reference to the accompanying drawings, wherein.

DETAILED DESCRIPTION OF THE INVENTION

Figure 1:
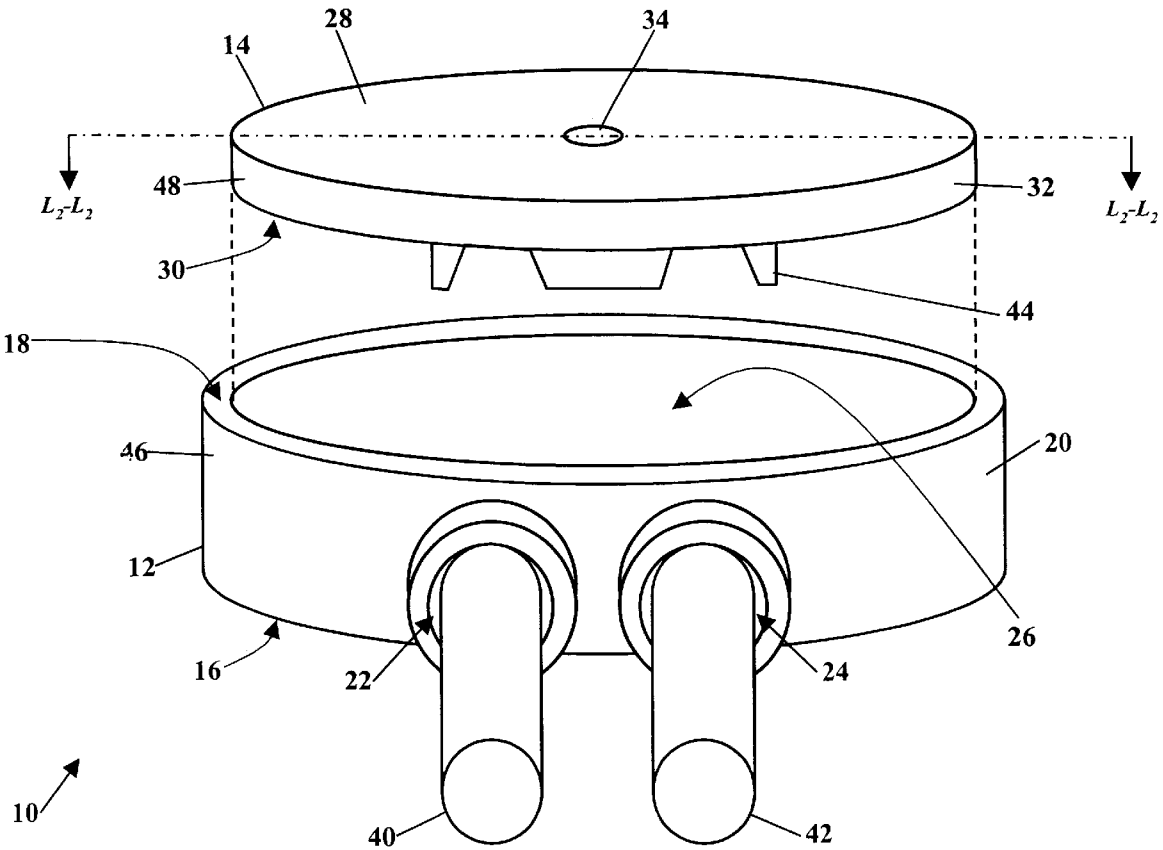
FIGS. 1 and 2 are schematics showing one embodiment of this invention.
Figure 2:
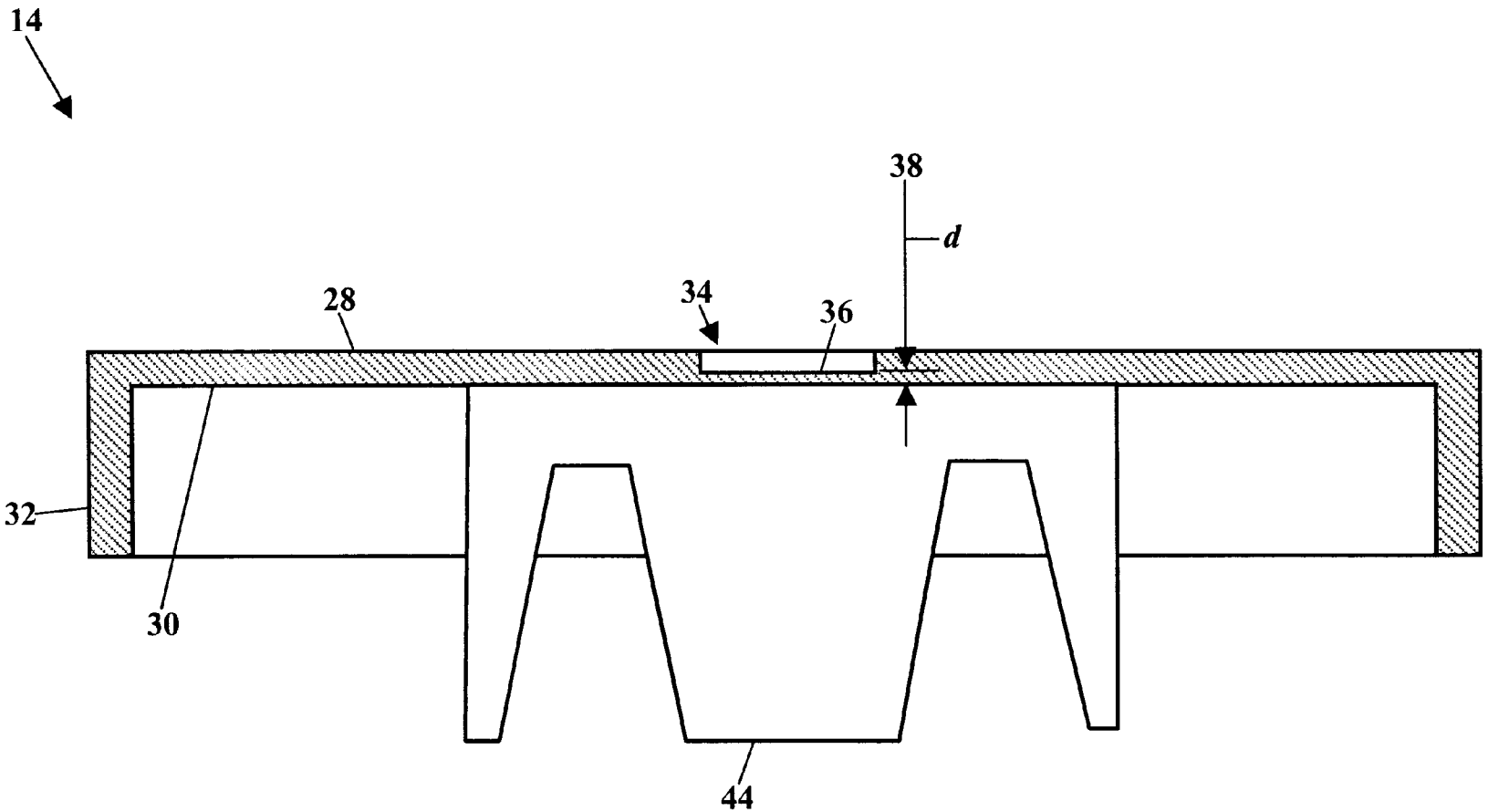

FIGS. 1 and 2 illustrate one embodiment of this invention. FIG. 1 is an exploded, isometric view of an apparatus 10 for electrically connecting at least two conductors. The apparatus 10 comprises a body 12 and a cap 14 engaging the body 12. FIG. 2 is a sectional view of the cap 14 taken along line $L_2$—$L_2$ of FIG. 1. FIG. 2 is also enlarged for clarity. As FIG. 1 shows, the body 12 comprises a bottom 16, an open top 18, at least one body side wall 20, and at least two apertures 22 and 24. The at least one body side wall 20 extends up from the bottom 16. Each of the at least two apertures 22 and 24 extend through the body side wall 20 and into an interior region 26 of the body 12. The top 18 is open to the interior region 26 of the body 12.

The cap 14 engages the body 12. The cap 14 may slide into or over the body 12. The cap 14 has a top surface 28, a bottom surface 30, at least one cap side wall 32, and a cavity 34. The at least one cap side wall 32 extends down from the bottom surface 30 of the cap 14. If the cap 14 slides into the body 12, the cap side wall 32 would interiorly lie to the body side wall 20. If, however, the cap 14 slides over the body 12, the cap side wall 32 would exteriorly lie to the body side wall 20. The cavity 34 downwardly extends from the top surface 28 of the cap 14 toward the bottom surface 30 of the cap 14. As FIG. 2 best shows, the cavity 34 terminates at a floor 36 positioned between the top surface 28 of the cap 14 and the bottom surface 30 of the cap 14. The floor 36 has a puncturable floor thickness "d" (shown as reference numeral 38) to provide access to the interior region 26 of the body 12.

The cap 14 assembles to the body 12. The at least two conductors 40 and 42 are inserted into and through the respective apertures 22 and 24. If the apparatus 10 is designed to connect more than the two conductors 40 and 42, then the body 12 would have an aperture corresponding to each conductor. The at least two conductors 40 and 42 insert through their respective apertures 22 and 24 and into the interior region 26 of the body 12. When the cap 14 and the body 12 engage, the at least two conductors 40 and 42 are crimped in electrical connection with a terminal 44. The terminal 44 is preferably interiorly positioned to the downwardly extending cap side wall 32, and the terminal 44 is preferably secured to the bottom surface 30 of the cap 14. As the cap 14 is pushed into or over the body 12, the conductors 40 and 42 are crimped into electrical connection by the terminal 44.

Once the cap 14 is assembled to the body 12, the cavity 34 provides access to the terminal 44. The floor 36 has a puncturable floor thickness "d" (shown as reference numeral 38) to provide access to the interior region 26 of the body 12. When a craftsperson must test the connection between the conductors 40 and 42, the craftsperson punctures the floor 36 of the cavity 34. The craftsperson may then insert a blunt or pointed test probe (not shown) into the cavity 34, through the punctured floor 36, and into the interior region 26 of the body 12. The craftsperson, most commonly, will puncture the floor 36 of the cavity 34 using the pointed test probe. The cavity 34 is preferably positioned above the terminal 44 so that the craftsperson may obtain currents and voltages at the terminal 44. The cavity 34, however, may also or alternatively angle toward the terminal 44. Because the floor 36 of the cavity 34 is puncturable, the floor thickness "d" is preferably between about 0.005 millimeters and about 0.3 millimeters, more preferably between about 0.01 millimeters and about 0.1 millimeters, and most preferably between about 0.03 millimeters and about 0.05 millimeters. The floor 36 of the cavity 34 thus resembles a thin film, a moderately thick film, or a thick film.

FIGS. 1 and 2 show the apparatus 10 having a generally cylindrical shape. The body side wall 20 extends up from the bottom 16 and has a cylindrical shape 46. The cap side wall 32 also has a generally cylindrical shape 48. If the cap 14 slides into the body 12, the cap side wall 32 would have a smaller diameter than the body side wall 20. If, however, the cap 14 slides over the body 12, the cap side wall 32 would have a larger diameter than the body side wall 20.

Figure 3:
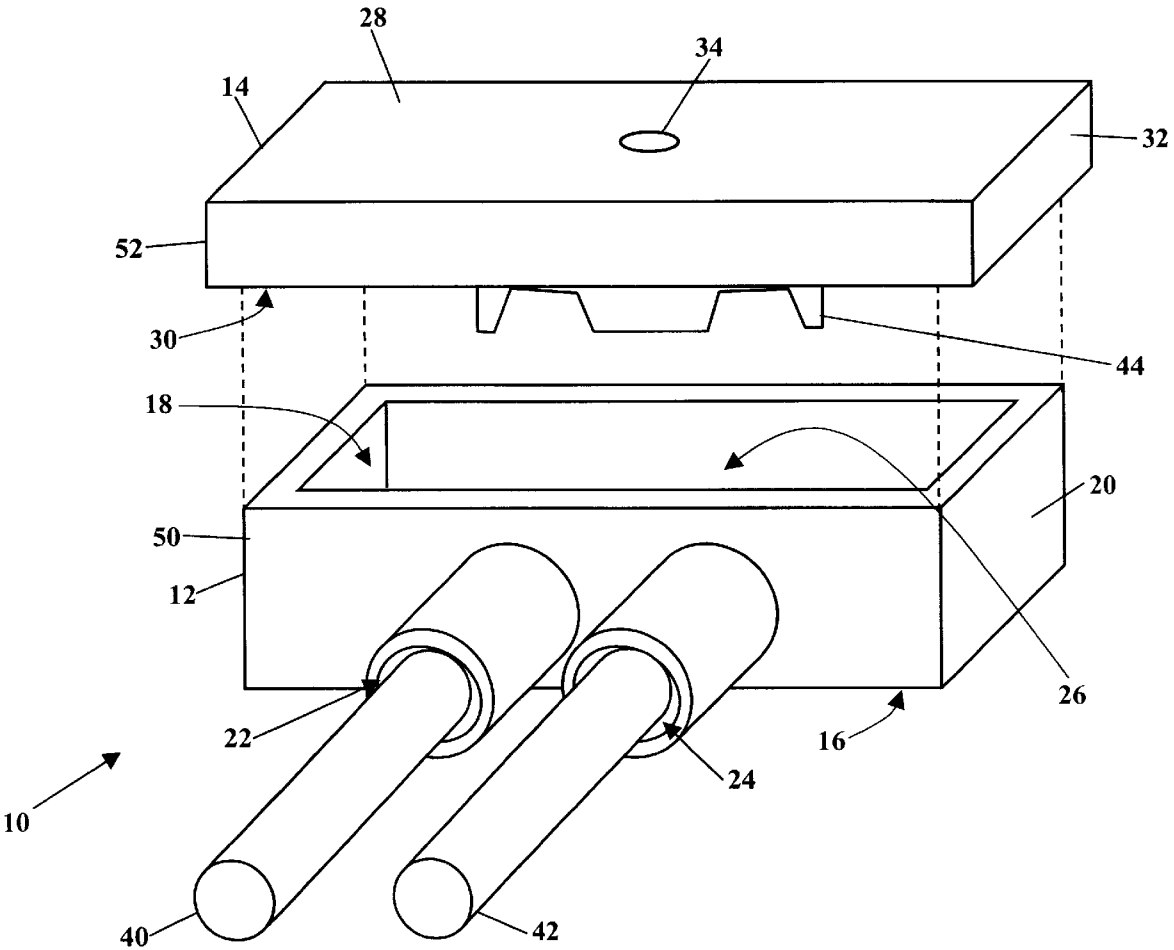
FIG. 3 is a schematic showing another embodiment of this invention.

FIG. 3 is a schematic showing an alternative embodiment of this invention. Whereas FIGS. 1 and 2 show the apparatus 10 having a generally cylindrical shape, FIG. 3 shows the apparatus 10 having a generally rectangular shape. The body side wall 20 extends up from the bottom 16 and has a box-like rectangular shape 50. The cap side wall 32 also has a generally rectangular shape 52. If the cap 14 slides into the body 12, the cap side wall 32 would have a smaller diameter than the body side wall 20. If, however, the cap 14 slides over the body 12, the cap side wall 32 would have a larger diameter than the body side wall 20. FIG. 3 also demonstrates that the apparatus 10 may have any polygonal shape. The body side wall 20 and the cap side wall 32 may have a generally square shape, triangular shape, pentagonal shape, or any other polygonal shape.

Figure 4:
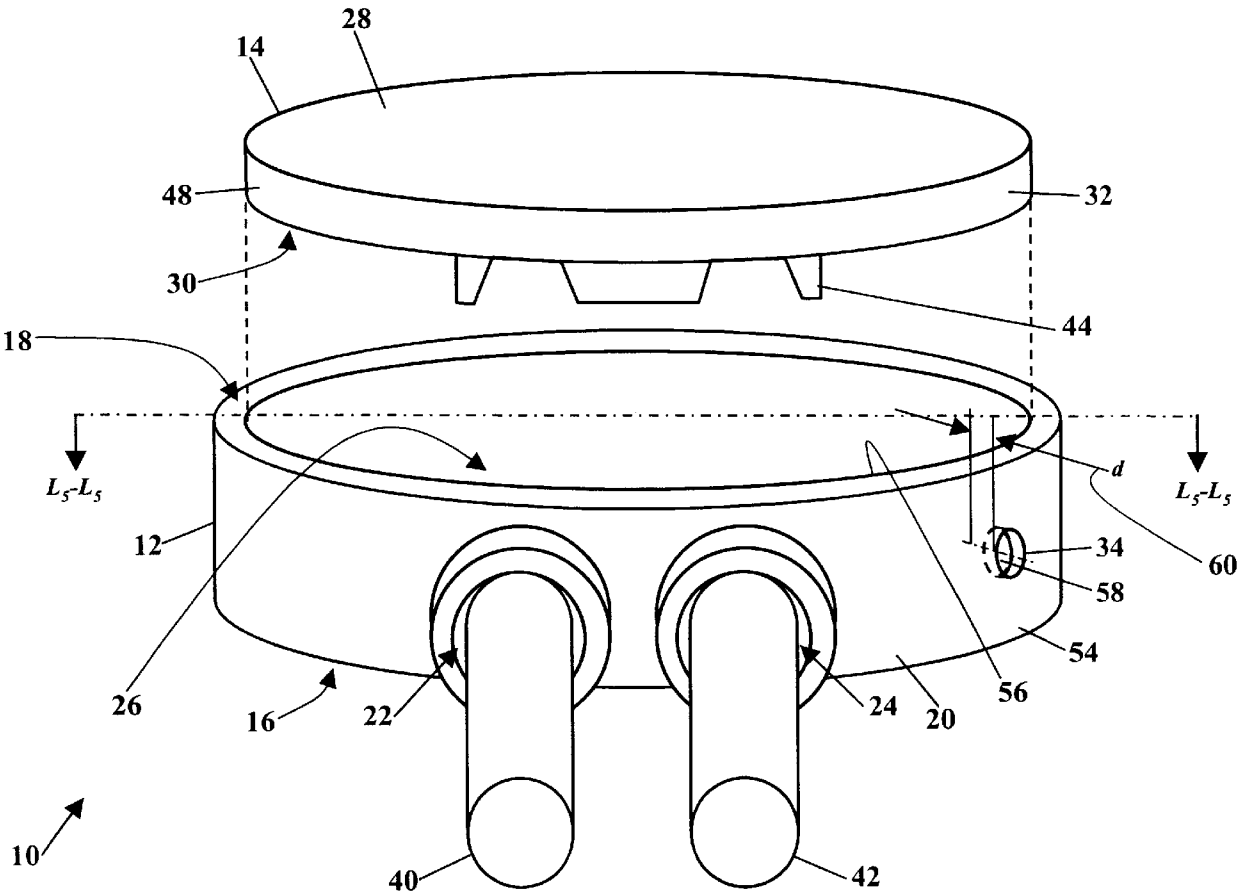
FIG. 4 is a schematic showing an alternative embodiment of this invention.

FIG. 4 is a schematic showing another alternative embodiment of this invention. FIG. 4 shows the apparatus 10 for connecting the at least two conductors 40 and 42. Here, however, the cavity 34 extends from an outer surface 54 of the body side wall 20 toward an inner surface 56 of the body side wall 20. The cavity 34 terminates at a cavity end wall 58, and the cavity end wall 58 exists between the outer surface 54 and the inner surface 56 of the body side wall 20. The cavity end wall 58 has a puncturable wall thickness "d" (shown as reference numeral 60) to provide access to the interior region 26 of the body 12. The cap 14, as before, engages the body 12 and the at least two conductors 40 and 42 are crimped into electrical connection by the terminal 44. Once the cap 14 is assembled to the body 12, the cavity 34 provides access to the terminal 44. The craftsperson inserts a pointed instrument into the cavity 34 and punctures the cavity end wall 58. The cavity 34 is preferably aligned to the terminal 44 so that the craftsperson may obtain currents and voltages at the terminal 44. Because the cavity end wall 58 is puncturable, the wall thickness "d" of the cavity end wall 58 is preferably between about 0.005 millimeters and about 0.3 millimeters, more preferably between about 0.01 millimeters and about 0.1 millimeters, and most preferably between about 0.03 millimeters and about 0.05 millimeters.

Figure 5:
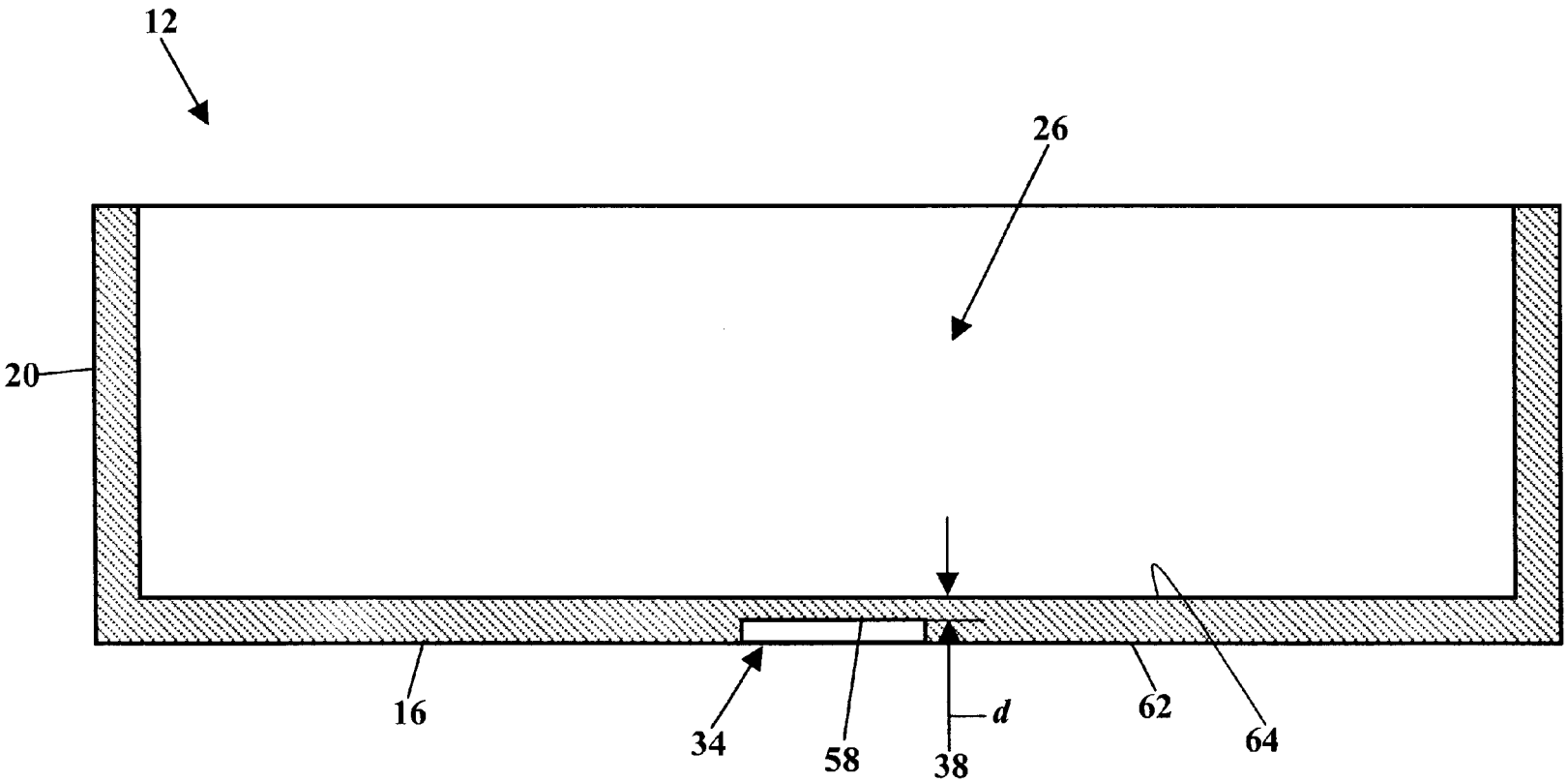
FIG. 5 is a schematic showing yet another alternative embodiment of this invention.

FIG. 5 is a schematic showing yet another alternative embodiment of this invention. FIG. 5 is a sectional view of the body 12 taken along line $L_5$—$L_5$ of FIG. 4. FIG. 5 is enlarged for clarity and shows the cavity 34 inwardly extends from the bottom 16 of the body 12 toward the interior region 26 of the body. The cavity 34, in particular, extends from an outer surface 62 of the bottom 16 toward an inner surface 64 of the bottom 16. The cavity terminates at the cavity end wall 58, and the cavity end wall 58 exists between the outer surface 62 and the inner surface 64 of the bottom 16. The cavity end wall 58, as before, has a puncturable wall thickness "d" (shown as reference numeral 66) to provide access to the interior region 26 of the body 12. Once the cap (shown as reference numeral 14 in FIGS. 1, 3, & 4) is assembled to the body 12, the cavity 34 provides access to the terminal (shown as reference numeral 44 in FIGS. 1, 3, & 4). The craftsperson inserts a pointed instrument into the cavity 34 and punctures the cavity end wall 58. The cavity 34 is preferably positioned below the terminal so that the craftsperson may obtain currents and voltages at the terminal. The cavity 34, however, may also or alternatively angle inward toward the terminal. Because the cavity end wall 58 is puncturable, the wall thickness "d" of the cavity end wall 58 is preferably between about 0.005 millimeters and about 0.3 millimeters, more preferably between about 0.01 millimeters and about 0.1 millimeters, and most preferably between about 0.03 millimeters and about 0.05 millimeters.

All the embodiments of this invention may include a moisture-resistent gel. This gel is injected into the body prior 12 to assembling the cap 14. The gel preferably fills the interior region 26 and extends into the apertures 22 and 24. The gel surrounds the terminal 44 and helps reduce corrosive degradation of the electrical connection.

The apparatus 10 of this invention may also have a two-stage assembly process. An initial stage has the terminal 44 secured to the cap 14, and the cap 14 is only partially inserted into, or onto, the body 12. The gel, if used, is injected into the body 12 either before the cap 14 is partially inserted, or after the cap 14 is partially inserted. The apparatus 10 is then packaged for storage and/or for sale. The second stage occurs when the conductors 40 and 42 are inserted into and through the respective apertures 22 and 24. The conductors 40 and 42 may have any outer insulation stripped to reveal an inner metallic conductor, or the conductors 40 and 42 may be inserted with the existing outer insulation. The conductors 40 and 42 are inserted into the interior region 26 of the body 12. The cap 14 is then completely pushed, clamped, or crimped into, or onto, the body 12. As the cap 14 is pushed into or over the body 12, the second stage crimps the conductors 40 and 42 into electrical connection by the terminal 44.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. An apparatus for connecting at least two conductors, comprising:

a body comprising a bottom, an open top, at least one body side wall, and at least two apertures, the at least one body side wall extending up from the bottom, each of the at least two apertures extending through the body side wall and into an interior region of the body, the top open to the interior region of the body; and a cap engaging the body, the cap having a top surface, a bottom surface, at least one cap side wall, and a cavity, the at least one cap side wall extending down from the bottom surface of the cap, the cavity downwardly extending from the top surface of the cap toward the bottom surface of the cap, the cavity terminating at a floor, the floor between the top surface of the cap and the bottom surface of the cap, the floor having a puncturable thickness to provide access to the interior region of the body, wherein the at least two conductors are positioned in the apertures, and when the cap and the body engage, the at least two conductors are crimped in electrical connection with a terminal in the interior region of the body, and the floor in the cavity is punctured to provide access to the terminal.

2. An apparatus according to claim 1, wherein the body side wall and the cap side wall each have a cylindrical shape.

3. An apparatus according to claim 1, wherein the body side wall and the cap side wall each have a rectangular shape.

4. An apparatus according to claim 1, wherein the body side wall and the cap side wall each have a polygonal shape.

5. An apparatus according to claim 1, wherein the floor has a floor thickness measured between the bottom surface of the cap and the floor of the cavity, the floor thickness preferably between about 0.005 millimeters and about 0.3 millimeters, more preferably between about 0.01 millimeters and about 0.1 millimeters, and most preferably between about 0.03 millimeters and about 0.05 millimeters.

6. An apparatus according to claim 1, wherein the terminal is interiorly position to the downwardly extending cap side wall and secured to the bottom surface of the cap.

7. An apparatus for connecting at least two conductors, comprising:

a body comprising a bottom, an open top, at least one body side wall, at least two apertures, and a cavity, the at least one side wall extending up from the bottom, each of the at least two apertures extending through the body side wall and into an interior region of the body, the top open to the interior region of the body, the cavity extending from an outer surface of the body toward an inner surface of the body, the cavity terminating at an cavity end wall, the cavity end wall having a puncturable thickness to provide access to the interior region of the body; and a cap engaging the body, wherein the at least two conductors are positioned in the apertures, and when the cap and the body engage, the at least two conductors are crimped in electrical connection with a terminal in the interior region of the body, and a floor in the cavity end wall is punctured to provide access to the terminal.

8. An apparatus according to claim 7, wherein the body side wall has an outer surface and an inner surface, the cavity extending from the outer surface of the body side wall toward the inner surface of the body side wall, the cavity terminating at the cavity end wall, the cavity end wall between the outer surface and the inner surface of the body side wall.

9. An apparatus according to claim 7, wherein the bottom of the body has an outer surface and an inner surface, the cavity extending from the outer surface of the bottom toward the inner surface of the bottom, the cavity terminating at the cavity end wall, the cavity end wall between the outer surface and the inner surface of the bottom.

10. An apparatus according to claim 7, wherein the body side wall has a cylindrical shape.

11. An apparatus according to claim 7, wherein the body side wall has a rectangular shape.

12. An apparatus according to claim 7, wherein the body side wall has a polygonal shape.

13. An apparatus according to claim 7, wherein the cavity end wall has a wall thickness measured between the inner surface of the body and the cavity end wall, the wall thickness preferably between about 0.005 millimeters and about 0.3 millimeters, more preferably between about 0.01 millimeters and about 0.1 millimeters, and most preferably between about 0.03 millimeters and about 0.05 millimeters.

14. An apparatus according to claim 7, wherein the terminal is secured to a bottom surface of the cap.

* * * * *